US005101523A

United States Patent [19]

Bright

[11] Patent Number: 5,101,523

[45] Date of Patent: Apr. 7, 1992

[54] MULTIFUNCTIONAL CONVERTIBLE FURNITURE WITH SHELF PORTION

[76] Inventor: Darwin G. Bright, P.O. Box 324, Campbellford, Ontario, Canada, K0L 1L0

[21] Appl. No.: 594,383

[22] Filed: Oct. 9, 1990

[51] Int. Cl.[5] ..... A47C 17/58; A47C 17/54

[52] U.S. Cl. ..... 5/2.1; 5/136; 108/39; 312/316

[58] Field of Search ..... 5/2.1, 159.1, 136; 312/314, 316; 108/39

[56] References Cited

U.S. PATENT DOCUMENTS

| | | | |
|---|---|---|---|
| 158,986 | 1/1875 | Schwartz et al. | 5/136 |
| 177,941 | 5/1876 | Horsfall | 5/2.1 |
| 2,257,625 | 9/1941 | Thomas | 5/136 |
| 2,770,813 | 11/1956 | Marzillier | 5/2.1 |
| 3,858,253 | 1/1975 | Lauzon | 5/2.1 |
| 4,694,518 | 9/1987 | Lukich et al. | 5/2.1 |

*Primary Examiner*—Alexander Grosz

*Attorney, Agent, or Firm*—Harness, Dickey & Pierce

[57] ABSTRACT

A multifunctional, configuration-convertible furniture item is selectively convertible between at least two functional configurations. Such a furniture item includes a generally vertically upright shelving unit, with a movable frame portion and a movable extension portion. The frame portion is selectively movable between a generally vertically-extending orientation when in the above-mentioned first functional configuration and a vertically-elevated, generally horizontally-extending orientation when in a second functional configuration. The extension portion is selectively extendable outwardly from the shelving unit and selectively retractable thereto. When extended, the extension portion is vertically supported by the frame portion when the frame portion is in the second, generally horizontally-extending configuration, thus defining an elevated horizontal surface extending outwardly from the shelving unit, which can serve as a bed, a desk, a bench-type seat, or other functions in various embodiments.

20 Claims, 3 Drawing Sheets

70
72
71
60
61
73
62
63
30
32
33
34
31
18
36
44
80
42
20
46
38
53
54
10
28
24
22
16
12
26
52
50
14
5

MULTIFUNCTIONAL CONVERTIBLE FURNITURE WITH SHELF PORTION

BACKGROUND AND SUMMARY OF THE INVENTION

The invention relates generally to items of furniture, and more particularly to furniture items that are selectively convertible in configuration and thus capable of serving a number of different functional needs.

The expense of purchasing furniture items for the wide variety of needs of a typical household represents a major financial burden in many cases. In addition, the high cost of purchasing a home or condominium, or renting an apartment, frequently results in a limited amount of space to accommodate the varying needs or desires of occupants.

Because of these problems, many families and households are becoming increasingly interested in furniture items that are cost-effective, durable, and capable of performing more than one function. Thus, the need has arisen for sturdy furniture items capable of transfunctional or multifunctional conversion from one functional configuration to another. The present invention seeks to address this need by providing durable, multifunctional furniture items that are selectively convertible from one functional configuration to another, thus allowing the function and configuration of such furniture items to be changed to suit a number of different intended usages. In addition, the present invention seeks to provide such a furniture item that conserves space, especially in situations where one of the transfunctional, convertible configurations is used on a relatively infrequent basis.

In accordance with the present invention, a multifunctional, configuration-convertible furniture item is selectively convertible between at least two functional configurations. Such a furniture item according to the present invention includes a generally vertically upright shelving unit, with a movable frame portion and a movable extension portion. The frame portion is selectively movable between a generally vertically-extending orientation when in the above-mentioned first functional configuration and a vertically-elevated, generally horizontally-extending orientation when in a second functional configuration. The extension portion is selectively extendable outwardly from the shelving unit and selectively retractable thereto. When extended, the extension portion is vertically supported by the frame portion when the frame portion is in the second, generally horizontally-extending configuration, thus defining an elevated horizontal surface extending outwardly from the shelving unit.

The elevated horizontal surface formed by the extended extension portion can serve as a bed frame and supporting structure for a mattress, which may be used on a relatively infrequent basis, such as when overnight guests are present. Alternately, such elevated horizontal surface can serve as a desk, work table, or other horizontal table-like structure. In still another form of the invention, such elevated horizontal surface can serve as a supporting surface for cushions for a bench or other seating, thus providing additional seating capabilities when larger-than-normal groups of visitors are present.

Additional objects, advantages, and features are provided by the present invention and are directed toward enhancing the multi-use, transfunctional capabilities of the furniture items of the present invention. Such additional objects, advantages, and features will become apparent from the following description and the appended claims, especially when taken in conjuction with the accompanying drawings.

DETAILED DESCRIPTION OF THE PREFERRED EMBODIMENTS

Figure 3:
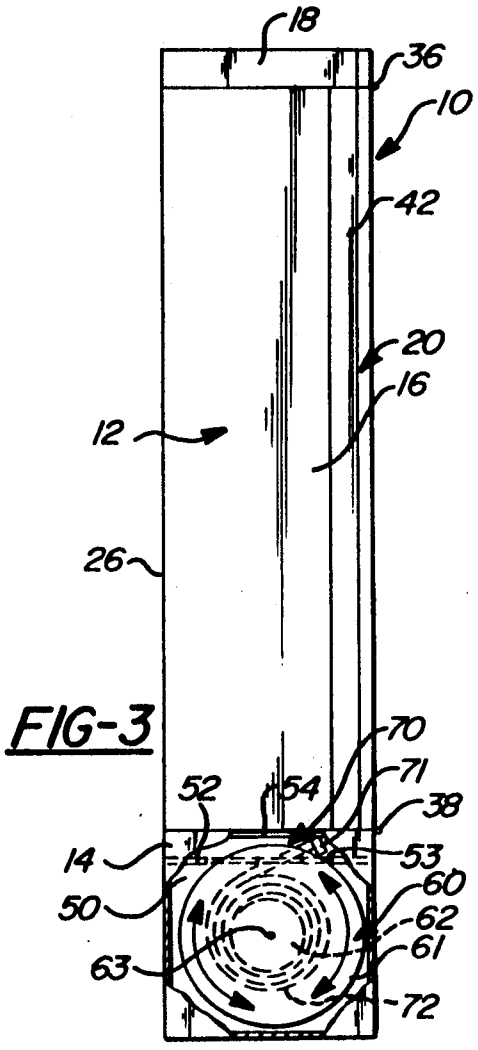
FIG. 3 is a left-hand end view of the furniture item of FIG. 1, with portions broken away to reveal internal components.

FIGS. 1 through 7 depict an exemplary embodiment of a furniture item according to the present invention, wherein the furniture item is selectively convertible between at least two functional configurations, namely a first configuration serving as a generally upright vertical shelving unit and a second configuration wherein a portion of the shelving unit is selectively moved to form a vertically-elevated, generally horizontally-extending surface capable of supporting a mattress and thus serving as a bed. One skilled in the art will readily recognize from the following discussion, however, that similar vertically-elevated, horizontally-extending surfaces can alternately serve as a desk, work table, or other such horizontal work surface, as well as supporting cushions for seating, or other such usages. One skilled in the art will also readily recognize that the principles of the present invention are equally applicable to furniture items other than that shown merely for purposes of illustration in the drawings.

Figure 2:
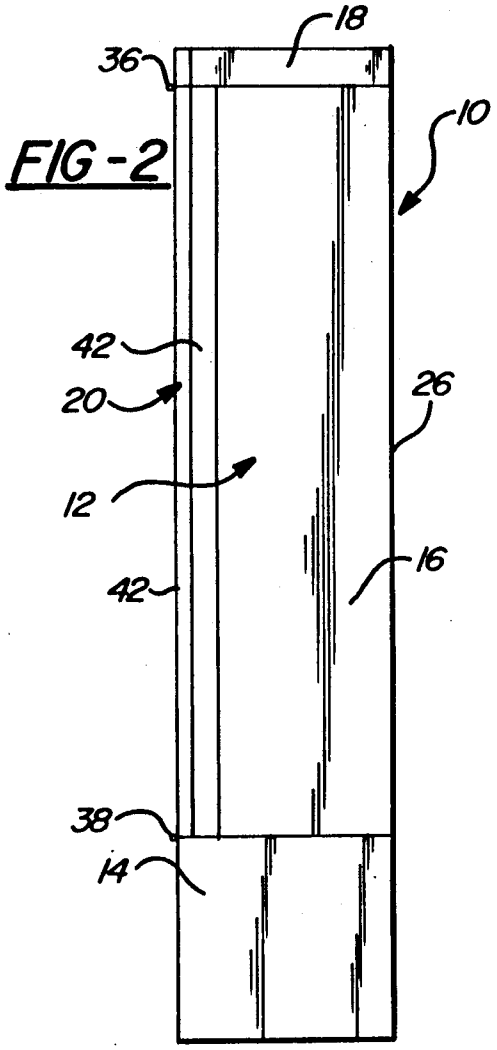
FIG. 2 is a right-hand end view of the furniture item of FIG. 1.
Figure 1:
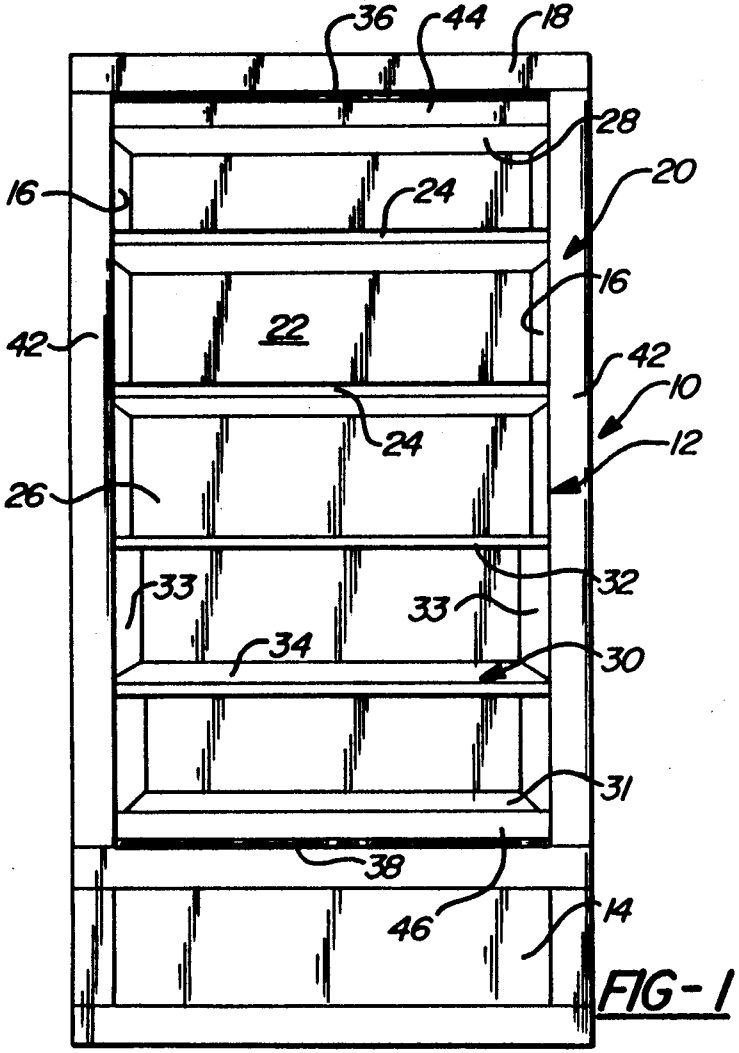
FIG. 1 is a front elevational view of an exemplary furniture item according to the present invention, illustrated in a first of its functional configurations.

Referring initially to FIGS. 1 through 3, an exemplary multifunctional furniture item 10 according to the present invention is shown in a first of its functional configurations and preferably includes a shelving unit 12, generally defined by a base section 14, a pair of spaced-apart sides 16, and an outer top member 18. A face frame 20 partially surrounds a shelf space 22 having a number of generally horizontally-extending shelves 24 therein and being partially enclosed by a back member 26 and an inside top member 28. Preferably, an internal shelving unit 30 includes an internal base 31, an internal top 32, a pair of internal sides 33, and one or more internal shelves 34. The internal shelving unit 30 is removably disposed within the shelf space 22, as illustrated in FIG. 1, and can be removed and selectively disposed in other locations, as described in more detail below.

Figure 5:
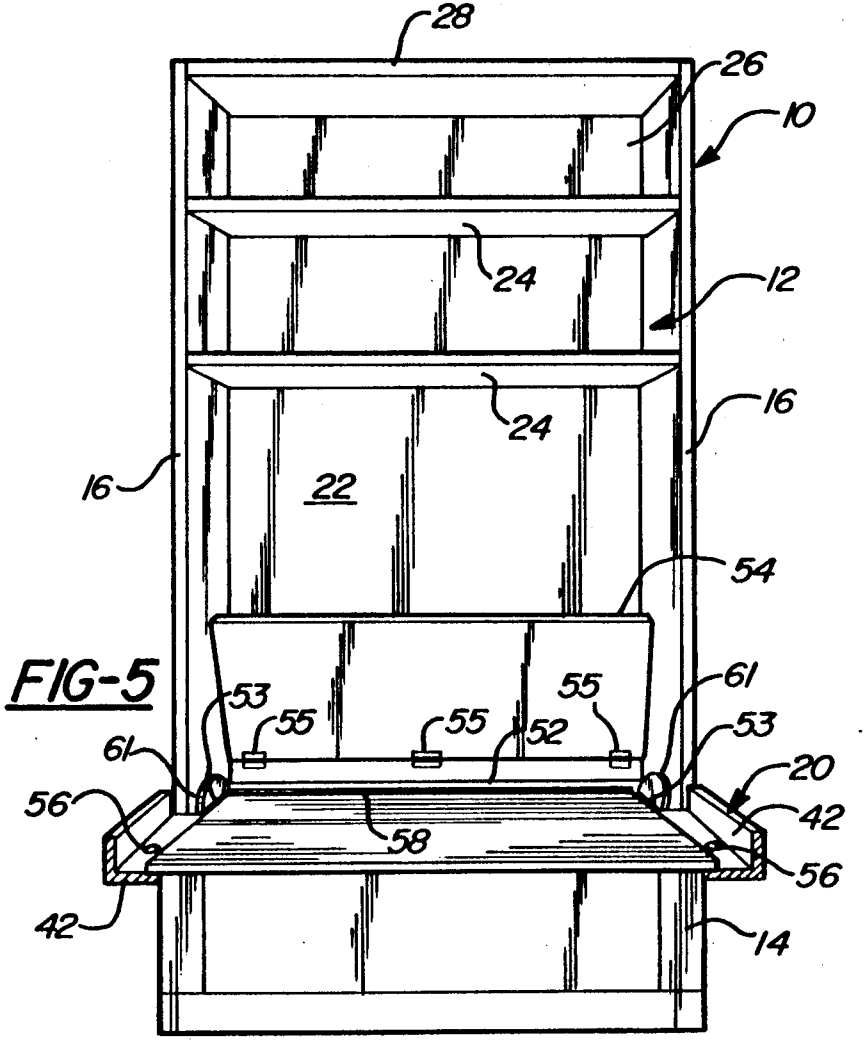
FIG. 5 is a view of the furniture item of FIG. 4, taken generally along line 5—5 of FIG. 4.
Figure 6:
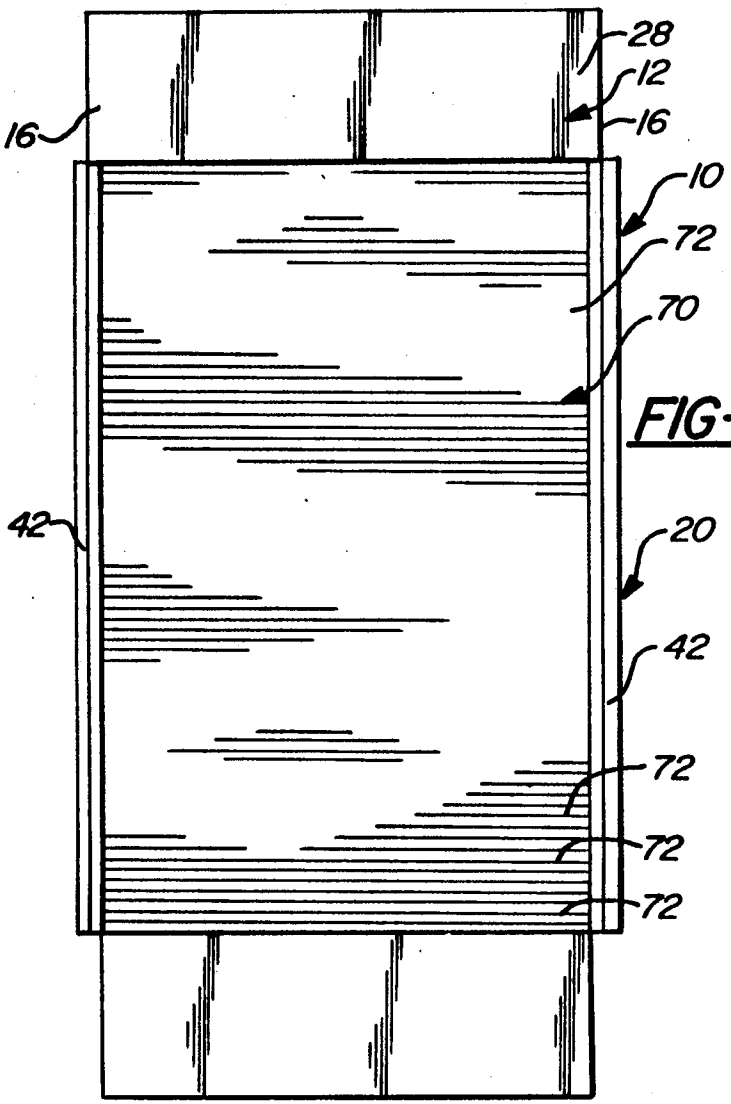
FIG. 6 is a top view of the furniture item of FIG. 4.
Figures 4, 7:
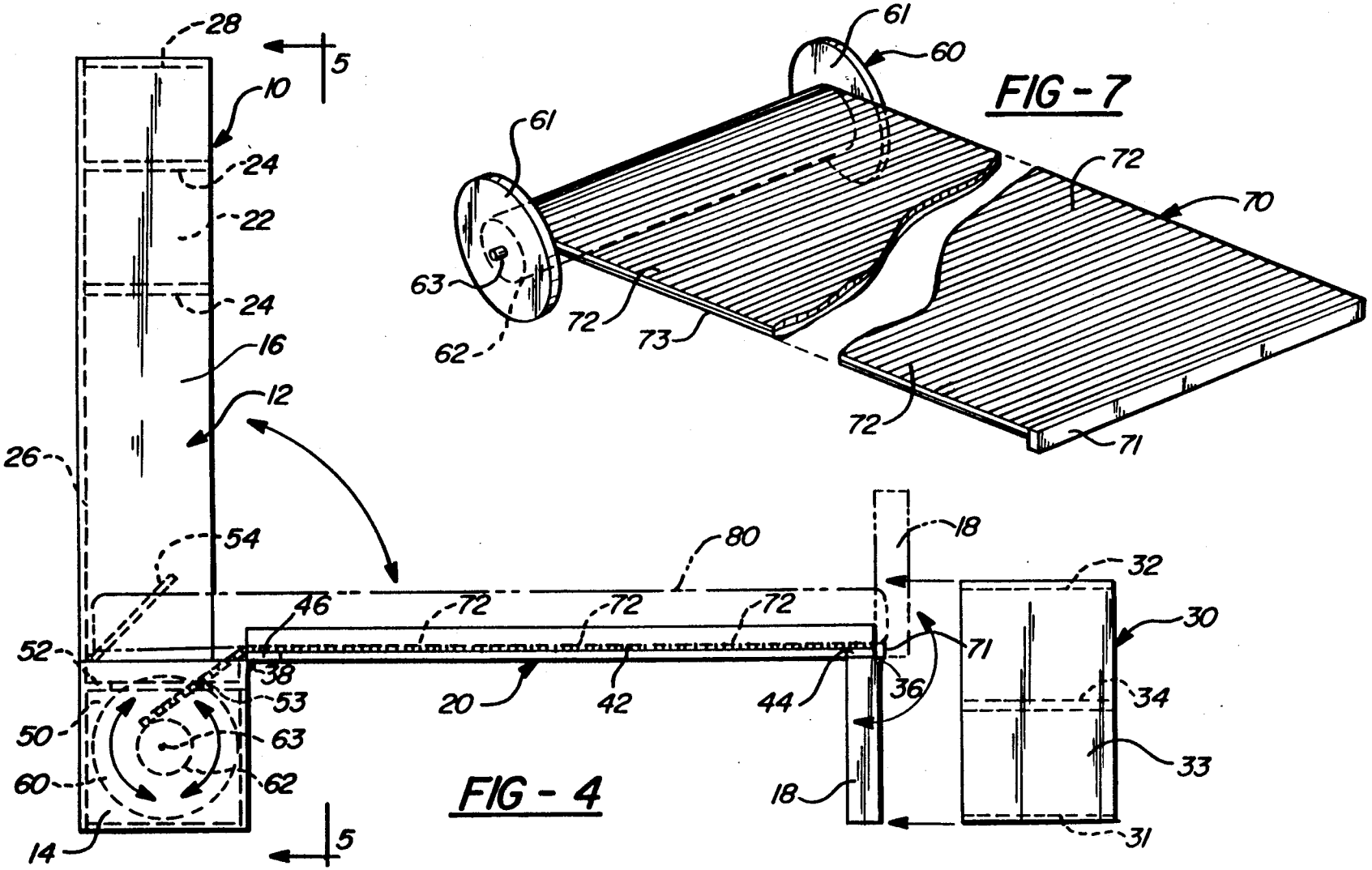
FIG. 4 is a side elevational view of the furniture item of FIGS. 1 through 3, but illustrating such furniture item in a second of its functional configurations.
FIG. 7 is a diagrammatic view of an extension portion of the furniture item of FIGS. 1 through 6.

A face frame 20 partially surrounds the shelf space 22 when in the first functional configuration and includes a pair of generally L-shaped rails (see FIG. 5), an upper end member 44, and a lower end member 46. The face frame 20 is preferably hingedly interconnected with the top member 18 by way of an upper hinge 36 and hingedly interconnected with the shelving unit 12, preferably adjacent the base section 14, by way of a lower hinge 38. As is illustrated in FIGS. 4 through 6, the face frame 20 and the top member 18, both of which are releasably attachable with the shelving unit 12 in the first functional configuration illustrated in FIGS. 1 through 3, are selectively movable to a second functional configuration illustrated in FIGS. 4 through 6, wherein the face frame 20 is in a vertically-elevated, generally horizontally-extending orientation. When pivoted to such an orientation, the top member 18 is hingedly movable from its previous upwardly-extending orientation (illustrated in phantom lines in FIG. 4) to a generally downwardly-extending orientation shown in solid lines in FIG. 4. As such, the top member 18 serves as a vertical support member for the outward end of the face frame 20, generally adjacent the upper end member 44. In like manner, by way of the attachment of the face frame 20 with the base section 14 through the lower hinge 38, the opposite end of the face frame 20 is vertically supported in its vertically-elevated orientation by the base section 14.

Preferably the base section 14 includes an internal storage space 50, including an inside shelf 52, with a pair of slots 53 and a slot 58 extending therethrough, as is best illustrated in FIG. 5. Such inside shelf 52 is selectively covered, along with the storage space 50 by a lid 54, which is hingedly interconnected with the base section 14 by one or more lid hinges 55. The inside shelf 52 can be supported in such closed position by any of a number of arrangements known to those skilled in the art, such as by the lid supports 56 on the face frame 20. The lid 54 is also selectively movable to an open position, as shown in FIGS. 4 and 5, to provide access to the storage space 50 and the internal components described below.

A spool 60 having a pair of spool flanges 61 and a spool hub 62, is supported for rotation within the storage space 50 by way of an axle 63, as is illustrated in FIGS. 3, 4, and 7. Preferably the spool flanges 61 are received in, and extend through, the above-mentioned slots 53 formed in the inside shelf 52, such that when the lid 54 is opened, the spool 60 can be selectively rotated.

A movable extension portion 70 has one end attached to the spool 60, with an opposite end extending through a second slot 58 formed in the inside shelf 52. Such extension portion 70 is selectively extendable from, and retractable into, the base section 14 when the face frame 20 and the top member 18 are in the horizontally-oriented, functional configuration illustrated in FIGS. 4 through 6. The preferred extension portion 70 includes an extension lip 71 at its free end and a number of extension members 72, which are hingedly interconnected with one another, in order to allow the extension portion to be foldably retracted or rolled onto the spool 60 in the base section 14 and unfoldably extended or unrolled outwardly therefrom. In the exemplary embodiment of the invention depicted in the drawings, such extension members 72 are preferably relatively narrow slats, which are hingedly interconnected by way of a fabric backing 73, thus forming a tambour arrangement that is extendable outwardly to be vertically supported by the preferred L-shaped rails 42 of the face frame 20, as illustrated in FIGS. 4 and 5. In this embodiment, a mattress 80, which can be foldably stored within the storage 50 of the base section 14, can be selectively disposed upon the extended face frame 20 and the extended extension portion 70, thus functioning as a bed for an overnight guest.

In another form of the present invention, the extension members 72 can be relatively wide, when compared to the narrow slat-like members illustrated in the drawings, and can be interconnected by suitable hinge members, such that the vertically-elevated, generally horizontally-extending portion of the furniture item when in the configuration illustrated in FIGS. 4 through 6, can serve as a desk, work table, or other such horizontal work surface. In still another alternate embodiment of the present invention, the extension member 72 can vertically support cushion members thus providing optional auxiliary seating when a large number of guests or visitors are present.

In any of the alternate embodiments discussed above, the extended extension portion 70 is releasably and removably retained in its extended position by way of an engagement of the extension lip 71 with the outer end of the horizontally-oriented face frame 20. As was mentioned above, the internal shelving unit 30 is selectively removable from within the shelf space 22, thus allowing access to the storage space 22 of the base section 50 for the above-described extension of the extension portion 70. The internal shelving unit 30 is then selectively disposable at the outer end of the extended face frame 20 and extension portion 70, in order to provide functional and decorative and functional storage shelving at the end of the furniture item when in the functional configuration shown in FIGS. 4 through 6. In addition, by disposing the removable internal shelving unit 30 at the outer or free end of the extended face frame 20, the vertically-oriented top member 18 is constrained in its proper orientation.

It should be noted that the various components of the exemplary multifunctional furniture item 10 shown merely for purposes of illustration in the drawings, and discussed above, should be constructed of highly durable, high-strength materials suitable for their intended usages and applications, as discussed above. In this regard, strength and durability are especially important for purposes of child safety when the furniture item is used in a child's room, and for purposes of long-term durability. Specific examples of such materials are well-known and thus will be readily apparent to those skilled in the art, and include high-strength plywood, high-density particle or chip board, long-wearing plastic laminates or hardwood veneers, and high-strength hinges or other hardware, all of which are well-known in applications where rugged usage is anticipated.

The foregoing discussion discloses and describes merely exemplary embodiments of the present invention for purposes of illustration only. One skilled in the art will readily recognize from such discussion, and from the accompanying drawings and claims, that various changes and modifications, and variations therein can be made without departing from the spirit and scope of the invention as defined in the following claims.

What is claimed is:

1. A multifunctional furniture item adapted to be selectively convertible between at least two functional configurations, said furniture item comprising a generally vertically upright shelving unit, said shelving unit having a movable frame portion and a movable extension portion, said frame portion being selectively movable between a generally vertically-extending orientation when in a first of said functional configurations and a vertically-elevated generally horizontally-extending orientation when a second of said functional configurations, said extension portion being selectively extendable outwardly from said shelving unit and selectively retractable thereto, said extension portion being vertically supported by said frame portion when selectively extended and when said movable frame portion is in said second functional configuration in order to define an elevated horizontal surface extending outwardly from said shelving unit.

2. A multifunctional furniture item according to claim 1, wherein said shelving unit includes a base section, a pair of sides and a top defining a front-open shelf space therebetween, and a number of generally horizontal shelves disposed with said shelf space and being supported by said sides, said base section having a storage space therein, said extension portion being selectively extendable and retractable from and into said storage space, respectively, and further being foldably storable therein when selectively retracted.

3. A multifunctional furniture item according to claim 1, wherein shelving unit includes a top member, a face frame, a shelf space having a number of horizontal shelves therein, said movable frame portion including said top member of said shelving unit and said face frame of said shelving unit, said face frame and said top member generally surrounding said shelf space and being releasably attached to said shelving unit when in said first functional configuration, said face frame having a lower end hingedly interconnected with said base section and an upper end hingedly interconnected with said top member, said top member being selectively and hingedly movable between a generally horizontally-inward orientation relative to said face frame when said movable frame is in said first functional configuration and a generally vertically-downward orientation relative to said face frame when said movable frame portion is in said second functional configuration, said face frame being vertically supported by said base section and said top member when in said second functional configuration.

4. A multifunctional furniture item according to claim 1, wherein said base section includes a storage space therein, said movable frame portion including a top member of said shelving unit and a face frame of said shelving unit, said face frame and said top member generally surrounding said shelf space and being releasably attached to said shelving unit when in said first functional configuration, said face frame having a lower end hingedly interconnected with said base section and an upper end hingedly interconnected with said top member, said top member being selectively and hingedly movable between a generally horizontally-inward orientation relative to said face frame when said movable frame is in said first functional configuration and a generally vertically-downward orientation relative to said face frame when said movable frame portion is in said second functional configuration, said face frame being vertically supported by said base section and said top member when in said second functional configuration.

5. A multifunctional furniture item according to claim 1, wherein said extension portion includes a number of hingedly interconnected generally flat extension members, said extension members being hingedly unfoldable in order to be selectively extendable and being hingedly foldable in order to be selectively retractable.

6. A multifunctional furniture item according to claim 5, wherein said extension members are hingedly interconnected by a foldable fabric secured to one side of each of said extension members in order to define a tambour member, said shelving unit including a lower base section having a storage space therein and a spool rotatably mounted within said storage space, an end of said tambour member being attached to said spool, said spool being selectively rotatable in a first direction to retract said tambour member into said storage space and selectively rotatable in a second opposite direction to extend said tambour member outwardly from said storage space.

7. A multifunctional furniture item according to claim 1, wherein said furniture item includes a storage space therein, said extension portion being selectively retractable into said space and being selectively extendable outwardly from said storage space, said shelving unit further including a mattress selectively storable in said storage space and selectively disposable upon said extended extension portion in order to define a bed when said extension portion is in said second functional configuration.

8. A multifunctional furniture item according to claim 7, wherein said furniture item further includes a lid hingedly interconnected therewith, said lid being selectively and hingedly movable between a first position substantially covering said storage space and a second position substantially exposing said storage space in order to provide access to said extension portion and said mattress.

9. A multifunctional furniture item according to claim 1, wherein shelving unit includes a self-supporting selectively removable internal shelving unit having an internal base, an internal top, a pair of internal sides, and at least one internal shelf, said internal shelving unit being selectively disposable within said shelving unit when said frame portion is in said first functional configuration and being selectively disposable adjacent said frame portion when in said second functional configuration.

10. A multifunctional furniture item adapted to be selectively convertible between at least two functional configurations, said furniture item comprising a base section, a top member, and a pair of generally vertical sides, said base section, said top member, and said sides defining a shelving unit having a shelf space therebetween, with a number of generally horizontal shelves disposed within said shelf space, said shelving unit having a movable frame portion and a movable extension portion, said movable frame portion including a face frame and said top member, said face frame having an upper end hingedly interconnected with said top member and a lower end hingedly interconnected with said base section, said movable frame portion being selectively and hingedly movable between a generally vertically-extending orientation when in a first of said functional configurations and a vertically-elevated generally horizontally-extending orientation when in a second of said functional configurations, said base section having a storage space therein, said movable extension portion being selectively extendable from said storage space and selectively retractable into said storage space when said movable frame portion is in said second functional configuration and being vertically supported by said movable frame portion when selectively extended and when said movable frame portion is in said second functional configuration in order to define an elevated horizontal surface extending outwardly from said shelving unit, said movable extension portion including a number of hingedly interconnected generally flat extension members, said extension members being hingedly unfoldable in order to be selectively extendable and hingedly foldable in order to be selectively retractable.

11. A multifunctional furniture item according to claim 10, wherein said extension members are hingedly interconnected by a foldable fabric secured to one side of each of said extension members in order to define a tambour member, said base section including a spool rotatably mounted within said storage space, an end of said tambour member being attached to said spool, said spool being selectively rotatable in a first direction to retract said tambour member into said storage space and selectively rotatable in a second opposite direction to extend said tambour member outwardly from said storage space.

12. A multifunctional furniture item according to claim 11, wherein said furniture item further includes a mattress selectively storable in said storage space and selectively disposable upon said extended tambour member in order to define a bed extending generally horizontally outwardly when said movable extension portion is extended and said movable frame portion is in said second functional configuration.

13. A multifunctional furniture item according to claim 12, wherein said furniture item further includes a lid hingedly interconnected therewith, said lid being selectively and hingedly movable between a first position substantially covering said storage space and a second position substantially exposing said storage space in order to provide access to said extension portion and said mattress.

14. A multifunctional furniture item according to claim 13, wherein shelving unit includes a self-supporting selectively removable internal shelving unit having an internal base, an internal top, a pair of internal sides, and at least one internal shelf, said internal shelving unit being selectively disposable within said shelving unit when said frame portion is in said first functional configuration and being selectively disposable adjacent said frame portion when in said second functional configuration.

15. A multifunctional furniture item according to claim 14, wherein said furniture item further includes a lid hingedly interconnected therewith, said lid being selectively and hingedly movable between a first position substantially covering said storage space and a second position substantially exposing said storage space in order to provide access to said extension portion and said mattress, said internal shelving unit being supported by said lid when disposed within said shelving unit.

16. A multifunctional furniture item according to claim 10, wherein said elevated horizontal surface defined by said selectively extended extension portion is adapted for supporting a mattress in order to function as a bed when said furniture item is in said second functional configuration.

17. A multifunctional furniture item according to claim 10, wherein said elevated horizontal surface defined by said selectively extended extension portion is adapted for supporting a cushion in order to function as a seating unit when said furniture item is in said second functional configuration.

18. A multifunctional furniture item according to claim 10, wherein said elevated horizontal surface defined by said selectively extended extension portion is adapted to function as a horizontal work surface.

19. A multifunctional furniture item according to claim 10, wherein said face frame includes elongated side rails, said side rails having a generally L-shaped cross-sectional shape, one leg portion of each of said L-shaped side rails extending generally vertically upwardly and the other leg portion of each of said L-shaped side rails extending generally horizontally inwardly when said furniture item is in said second functional configuration, said extension portion being selectively extendable to be vertically supported by said horizontal legs and to be laterally contained by said vertical legs.

20. A multifunctional furniture item according to claim 10, wherein said base section includes an inside shelf within said storage space, said inside shelf having an open slot therein, said extension portion extending through said slot to be selectively extendable and retractable therethrough.

* * * * *